US007280437B2

(12) United States Patent
Rochat

(10) Patent No.: US 7,280,437 B2
(45) Date of Patent: Oct. 9, 2007

(54) TIMEPIECE WITH A CALENDAR DISPLAY

(75) Inventor: Marco Rochat, Le Brassus (CH)

(73) Assignee: Frédéric Piguet S.A., Le Brassus (CH)

( * ) Notice: Subject to any disclaimer, the term of this patent is extended or adjusted under 35 U.S.C. 154(b) by 0 days.

(21) Appl. No.: 11/427,839

(22) Filed: Jun. 30, 2006

(65) Prior Publication Data

US 2007/0002690 A1 Jan. 4, 2007

(30) Foreign Application Priority Data

Jun. 30, 2005 (EP) ..... 05014135

(51) Int. Cl.
*G04B 19/24* (2006.01)

(52) U.S. Cl. ..... 368/37; 368/28

(58) Field of Classification Search ..... 368/28, 368/31–37, 76, 221, 223, 232, 233
See application file for complete search history.

(56) References Cited

U.S. PATENT DOCUMENTS

| | | | | |
|---|---|---|---|---|
| 96,792 | A | 11/1869 | Gale | |
| 5,184,333 | A * | 2/1993 | Caspar | 368/28 |
| 5,239,522 | A * | 8/1993 | Corlet | 368/31 |
| 5,379,272 | A * | 1/1995 | Parmigiani | 368/37 |
| 5,764,597 | A | 6/1998 | Shih | |
| 6,826,122 | B2 * | 11/2004 | Zaugg | 368/28 |

FOREIGN PATENT DOCUMENTS

| | | |
|---|---|---|
| CH | 660 440 G A3 | 4/1987 |
| EP | 0 606 576 A1 | 7/1994 |
| EP | 1 286 233 A1 | 2/2003 |
| EP | 1 637 942 A1 | 3/2006 |
| GB | 2 266 977 A | 11/1993 |

OTHER PUBLICATIONS

Austrian Search Report issued in corresponding application No. 200604187-5, completed Dec. 11, 2006.
Dershowitz, Nachum and Reingold, Edward, "The Chinese Calendar," (identified on p. 1 of the present specification as "Calendrical Calculations"), Cambridge University Press, 1997, pp. 243-264.
Alasken, Helmer, "The Mathematics of the Chinese Calendar," Mar. 29, 2006, pp. 1-52.
"Mathematica-Compatible Notebook," pp. 1-56 printed Jul. 13, 2006 from the website http://www.math.nus.edu.sg/alasken/cale. . . .
European Search Report issued in corresponding application No. EP 05 01 4135, completed Mar. 22, 2006.

* cited by examiner

*Primary Examiner*—Vit Miska
*Assistant Examiner*—Jeanne-Marguerite Goodwin
(74) *Attorney, Agent, or Firm*—Griffin & Szipl, P.C.

(57) ABSTRACT

A timepiece, includes a Chinese calendar display device indicating lunar date and lunar month, taking account of bissextile months, and: a control lever actuated each day by a drive wheel of the timepiece movement; a lunar month indicator associated with a month star-wheel; a lunar date indicator associated with a date wheel set including a date wheel moved forward one step each day by the control lever, a lunar month length indicator coupled to a selector, having two positions manually controlled and alternately defining two different stop positions for the lever, respectively corresponding to a long month and to a short month, the control lever moves the date wheel forward one extra step at the end of short months; and a month indicator coupled to a bissextile month selector, having two positions manually controlled and that moves the month star—wheel back one step at the start of bissextile months.

9 Claims, 10 Drawing Sheets

TIMEPIECE WITH A CALENDAR DISPLAY

This application claims priority from European Patent Application No. 05014135.7 filed Jun. 30, 2005, the entire disclosure of which is incorporated herein by reference.

BACKGROUND OF THE INVENTION

The present invention concerns a timepiece provided with a calendar mechanism activated each day by the timepiece movement and capable of displaying the date in accordance with the traditional Chinese calendar.

The Chinese calendar is still used nowadays to set the date of various festivities and for Chinese astrology. It is of the luni-solar type, in that it is based on lunar months which each begin on the day of the new moon, whereas the length of the Chinese years varies so as to be as close as possible to the tropical year.

The Chinese year starts on the second new moon that follows the winter solstice, with rare exceptions. Given that the length of the lunations is not constant and that its mean value (29.53088 days) is not equal to an integer number of days, the Chinese calendar includes long months of 30 days and short months of 29 days. No cycle of long and short months has been able to be defined.

Moreover, in order for the mean length of the Chinese years to coincide with that of a tropical year, normal years of twelve months and bissextile years of thirteen months, in which the extra month, called the bissextile month, is inserted in a position—- i.e. a row-which varies from one bissextile year to another as a function of astronomic data. This month takes the number of the preceding month, such that the last month of a year always takes the number 12. One inconvenient fact for a mechanical Chinese calendar display is that a position cycle of the bissextile month in the year has not been able to be defined.

Normal years can comprise 353, 354 or 355 days, whereas bissextile years can comprise 383, 384 or 385 days. Normal and bissextile years follow each other practically in a cycle of nineteen years, which corresponds to the Méton cycle of the Greek calendar and includes almost integer numbers of days, lunations and Chinese years, with twelve normal years and seven bissextile years. However, this cycle is not precise long term.

For further data as to the Chinese calendar, the reader can refer to the work of Nachum DERSHOWITZ and Edward M. REINGOLD, Calendrical Calculations, Cambridge University Press, 1997, and to the publications of Helmer ASLAKSEN: The Mathematics of the Chinese Calendar, 13 May 2004, and LeapMonths.nb, Mathematics package, 1999, available on the website.

Because of the peculiarities of the Chinese calendar summarized above, it is not currently possible to make a display mechanism for the dates of this calendar that can be driven by a timepiece movement and that can operate precisely long term without manual intervention, as can the known perpetual Julien or Gregorian date mechanisms, for example in accordance with CH Patent No. 660 440, or as provided by EP Patent No. 606 576 for a Muslim calendar display.

SUMMARY OF THE INVENTION

It is an object of the present invention to create a calendar mechanism driven daily by the movement of a timepiece and capable of displaying the dates of the traditional Chinese calendar at least in the form of the lunar date and the lunar month, taking account of bissextile months, and which can be made in practice and preferably in a quite reduced form to be incorporated in a watch. One basic idea of the invention consists in making a non-perpetual date mechanism, into which the person wearing the watch can manually enter the data necessary to obtain a correct display of the date, in an unconstrained manner.

There is therefore provided a timepiece including a timepiece movement and a Chinese calendar display device, characterized in that the Chinese calendar display device includes:

a calendar mechanism including a control lever actuated each day by a drive wheel of the timepiece movement;

a lunar month indicator associated with a month star-wheel having twelve teeth;

a lunar date indicator associated with a date wheel set including a date wheel with thirty teeth which is moved forward one step each day by a beak of the control lever, the date wheel set further including a drive finger arranged for moving the month star-wheel forward one step at the end of each revolution of the date wheel set;

a lunar month length selector, having at least two positions and cam surfaces acting as a support for the control lever, to define alternately two different stop positions for said lever respectively corresponding to a month of thirty days and to a month of twenty-nine days, the control lever being provided with a click cooperating with the date wheel set in order to move it one extra step via the movement of said lever at the end of a month of twenty nine days;

a first manual control lever arranged for changing the position of the lunar month length selector;

a bissextile month selector, having a normal position and a bissextile position and provided with a finger arranged for making the month star-wheel move back one step when said selector passes from the normal position to the bissextile position;

and a second manual control member arranged for making the bissextile month selector pass from the normal position to the bissextile position.

The lunar month length selector, which only has two different positions as regards their effect, can advantageously be coupled to a month length indicator, visible on the dial. Likewise, the bissextile month selector has only two positions as regards their effect and can advantageously be coupled to an indicator as to the type of month, visible on the dial.

Thus if the month length indicator indicates the correct length of the current month, the user of the timepiece need do nothing in order for the date and lunar month display to change correctly at the end of the last day of the month. If the user sees that the current month length indication is not correct, he can correct it by action on the first manual control member to set the month length indicator to the other position at any time, provided that it is before the action of the drive finger of the date wheel set at the end of that month.

When a bissextile month starts, the number of the month displayed by the lunar month indicator increases by one unit as in a normal month and it thus will have to be decreased by one unit to take the number of the preceding month. The user does this himself by actuating the second manual control member, which changes the position of the bissextile month sector and thus causes the month star-wheel and the indicator associated therewith to move back. It will be seen hereinafter that the selector can automatically return to its normal position at the end of the bissextile month, such that the user only needs to actuate the second control member once for each bissextile month, thus only seven times during a cycle of nineteen Chinese years.

Other features and advantages of the present invention will appear from the following description, which presents two advantageous embodiments by way of non-limiting example and with reference to the annexed drawings.

DETAILED DESCRIPTION OF ONE EMBODIMENT

Figure 1:
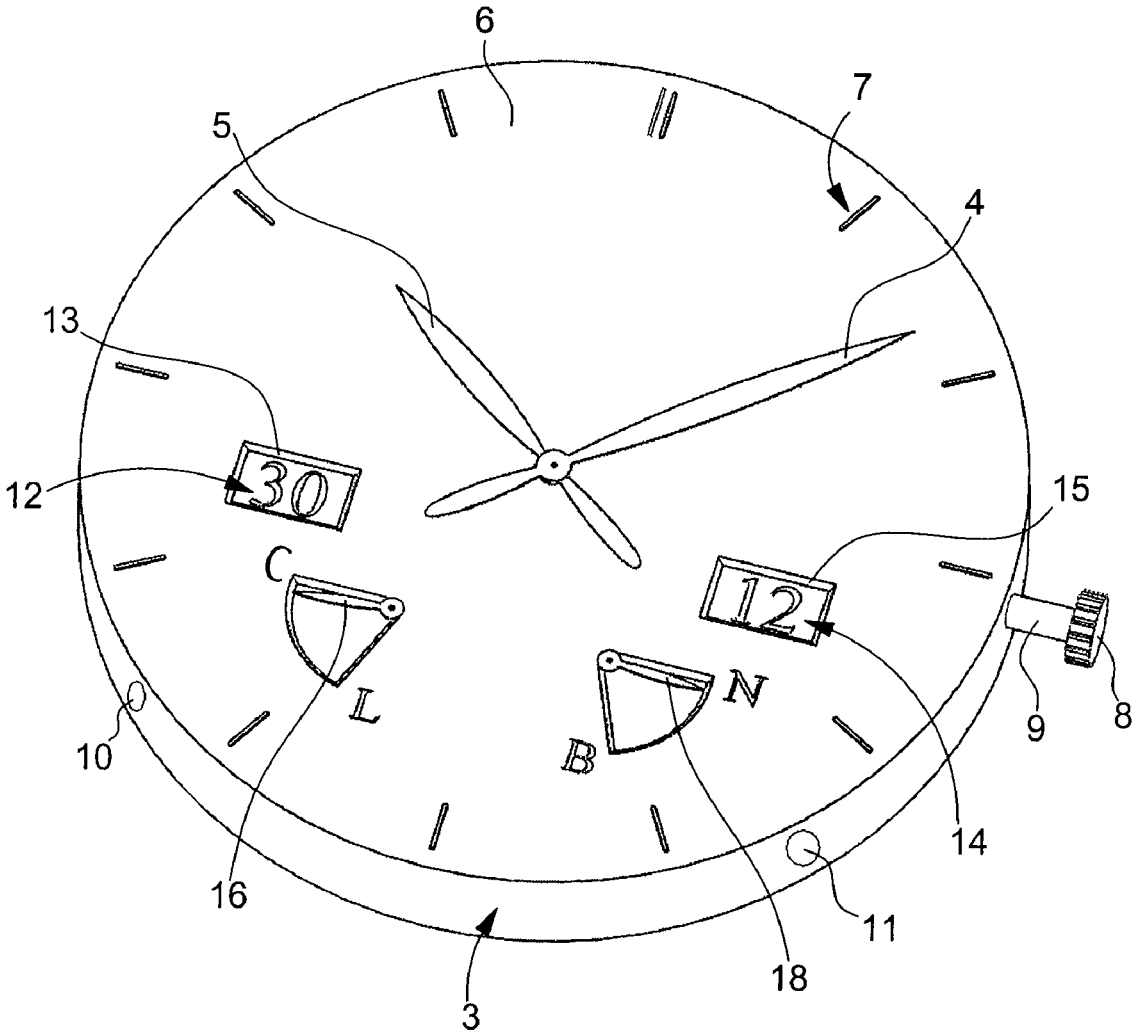
FIG. 1 is a schematic perspective view of a wristwatch movement associated with Chinese calendar display means according to a first embodiment of the invention.

The watch shown without its exterior in FIG. 1 includes, in a conventional manner, a case containing a mechanical or electromechanical watch movement, which activates an analogue time display. The later includes here a minute hand 4 and an hour hand 5 which rotate above a dial 6 provided with an hour circle 7. The watch can also include a usual calendar display, for example of the Julien type, which is driven once per day by the watch movement and which is not shown in the drawing. A crown 8 connected to a conventional control stem 9 enables the hour and date to be manually adjusted, and the movement to be wound if it is mechanical. Other manual control means are formed by push buttons 10 and 11 whose function will be explained hereinafter.

The watch further includes a Chinese calendar display including four indicators associated with dial 6, namely: a lunar date indicator 12 formed by a disc, one portion of which is visible in an aperture 13 of the dial; a lunar month indicator 14 formed by a disc, one portion of which is visible in another aperture 15 of the dial; a month length indicator 16 formed by a hand having two positions opposite two marks C and L on the dial; and finally a month type indicator 18 formed by a hand having two positions opposite two marks N and B on the dial. Marks C and L respectively represent a short lunar month of twenty-nine days and a long lunar month of thirty days. Marks B and N respectively represent a bissextile lunar month and a non-bissextile lunar month, which will be called a normal month. A normal month can be short or long, like a bissextile month. Indicators 12, 14, 16 and 18 are controlled by a Chinese calendar mechanism illustrated by FIGS. 2 to 13.

Calendar mechanism 20 partially shown in FIGS. 2 to 5 is actuated once per day by a drive wheel 21 which is driven by the watch movement hour wheel to make one revolution in twenty-four hours. Wheel 21 carries a drive pin 22 which acts on a control lever 23 pivoting about point 24, pin 22 being resiliently mounted on wheel 21 so as not to interfere with the correction movements of mechanism 20. A spring 25 tends to press a projecting portion 2*a* of an arm 26 of lever 23 against a selector 27 formed here by a column wheel, whose six columns 28 are similar and separated by equal gaps 32. The periphery of the column wheel forms a sort of cam which alternately determines two different stop positions of lever 23. Selector 27 further includes an external toothing 33, the number of teeth of which is double the number of columns, said toothing being held in position by a jumper-spring 34. toothing 33 further enables selector 27 to be moved forward step by step in the anti-clockwise direction by means of a selection lever 35 pivoting at 36, provided with a return spring and a tooth 37 at the end of a flexible arm. This lever is actuated by push-button 10 shown in FIG. 1.

A second arm 38 of lever 23 is provided with a beak 40 and a click 41, which pivots at 42 on the lever and is pushed in the clockwise direction by a spring 43 abutting against a pin 44 of the click.

The date indicator disc 12 (which is only shown very partially in FIGS. 2 to 5 for the sake of clarity of the drawing) forms part of a date wheel set 50 further including a date wheel 51 with thirty teeth, a month drive finger 52 and a cam 53 in the shape of a spiral, with a recess 54. Click 41 of lever 23 presses by sliding over this cam and can abut against recess 54. A jumper spring 56 stressed by a spring 57 abuts on the teeth of wheel 51 to hold it in thirty successive positions.

Like disc 12, month indicator disc 14 is only shown very partially in FIGS. 2 to 5. it is secured to a month wheel 60 with twelve teeth, held in position by a jumper spring 61 stressed by a spring 62. Finger 52 of date wheel set 50 moves wheel 60 and disc 14 forward one step at the end of each revolution of wheel set 50.

Figure 2:
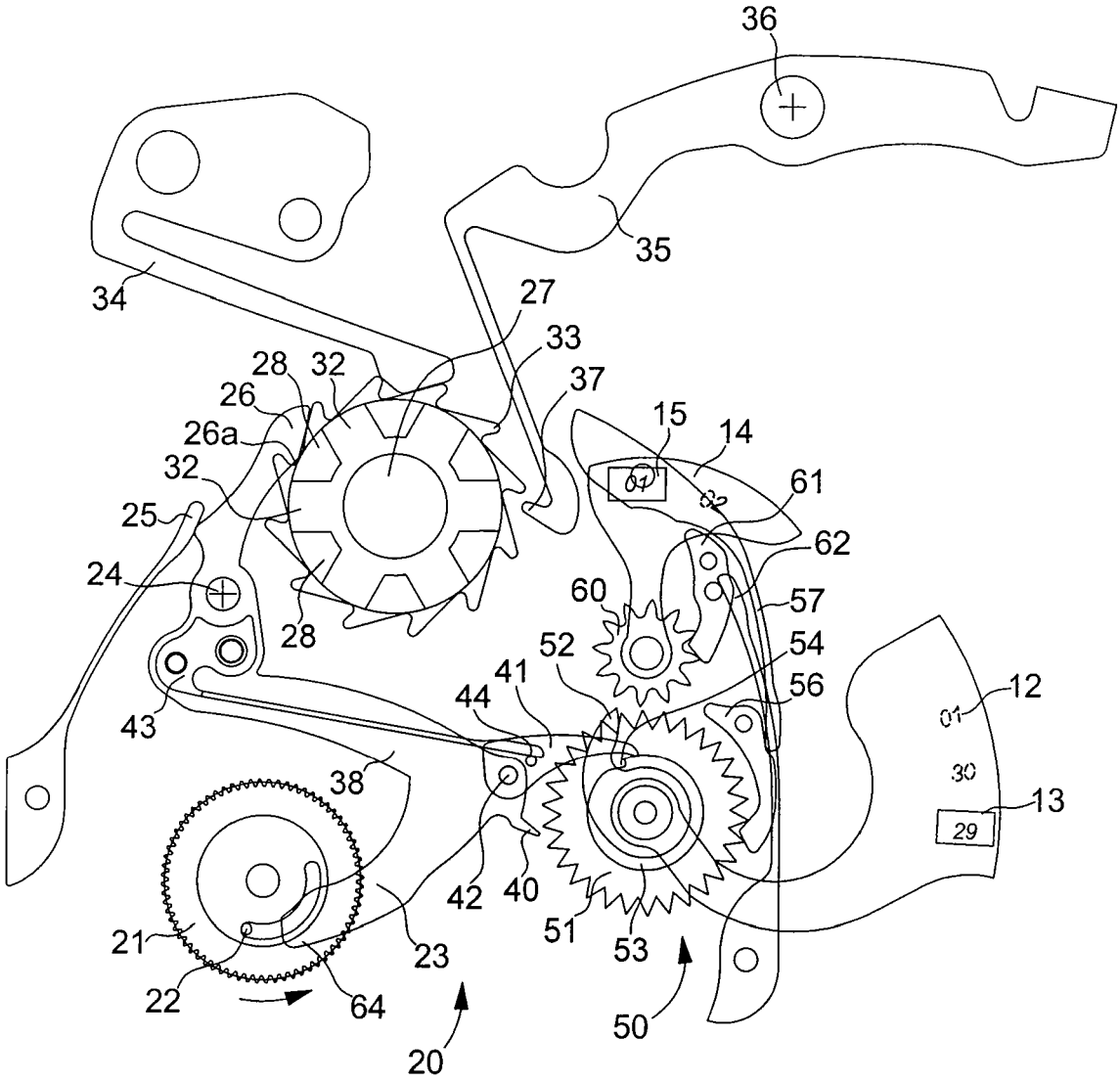
FIG. 2 shows one part of the mechanism actuating the Chinese calendar display of the watch of FIG. 1.
Figure 3:
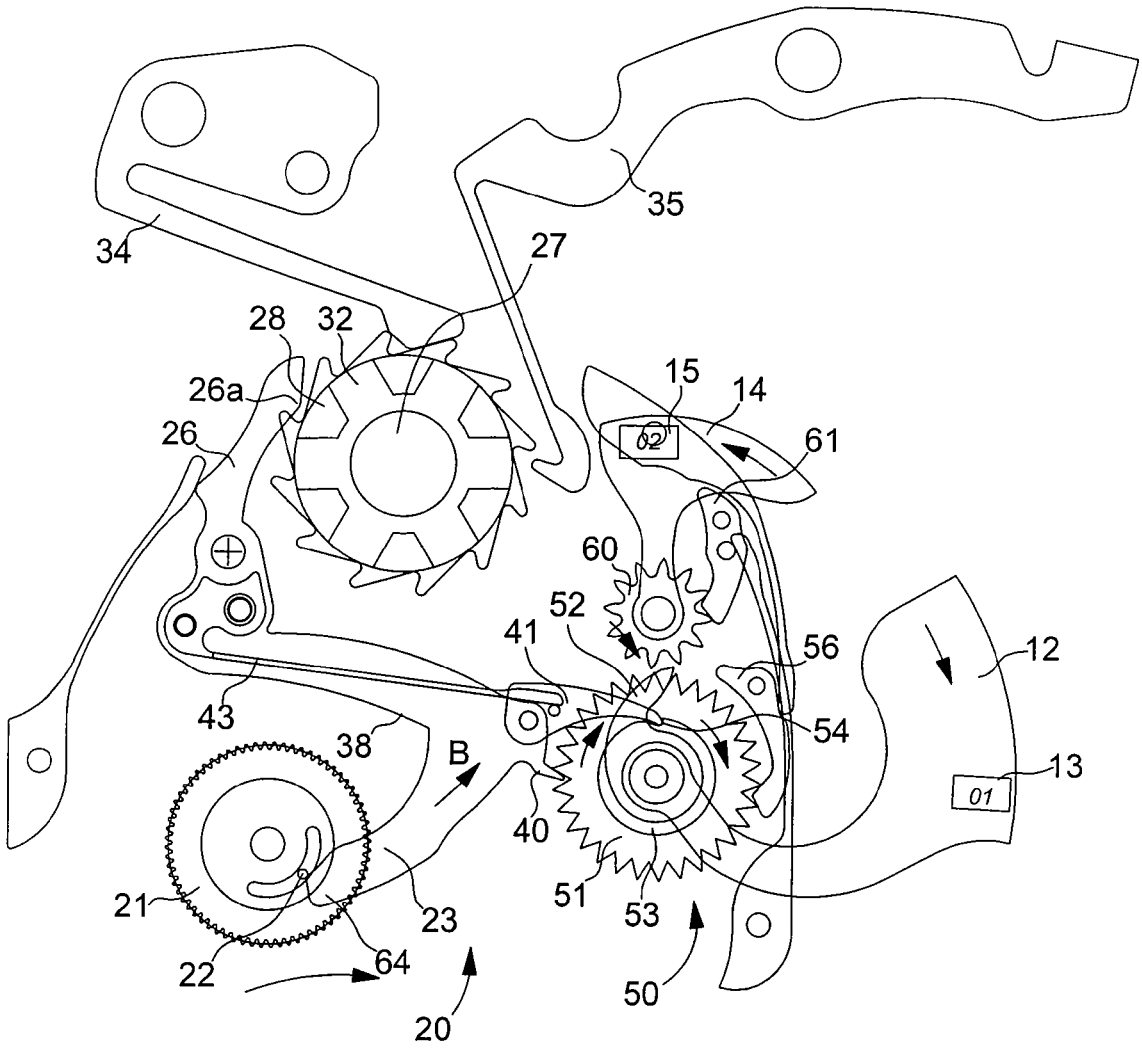
FIGS. 3 to 5 show the mechanism of FIG. 2 in other operating positions.

When the current lunar month is a long month, i.e. including thirty days, selector 27 has to be in the position shown in FIGS. 2 and 3, so that arm 26 of lever 23 abuts against one of columns 28 and the other end 64 of lever 23 is slightly shifted towards the right in relation to the axis of drive wheel 21. Every evening around midnight, as is seen in FIG. 3, pin 22 pushes this end to pivot lever 23 in the direction of arrow B, such that beak 40 of the lever enters into contact with the teeth of date wheel 51 and thus moves date module 50 forward one step, incrementing the date displayed in aperture 13 by one unit. On the evening of the thirtieth day of the month, the date indication thus passes from 30 to 01 as shown in FIG. 3. At the same time, finger 52 of wheel set 50 moves the month wheel 60 and disc 14 forward one step, incrementing the month number in aperture 15 by one unit. Also at the same time, click 41 of lever 23 falls into recess 54 of cam 53 without producing any particular effect.

Figure 4:
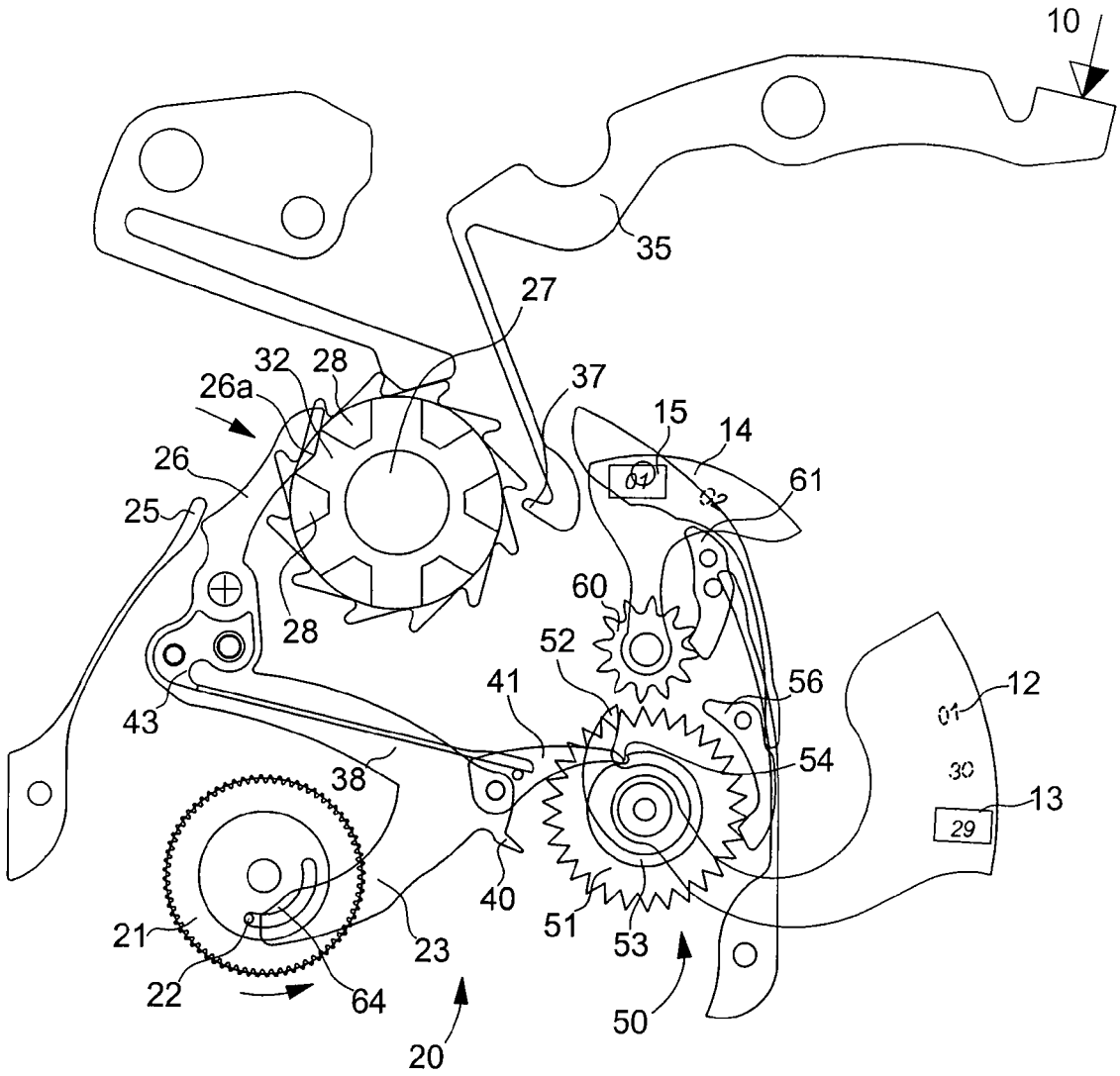
Figure 5:
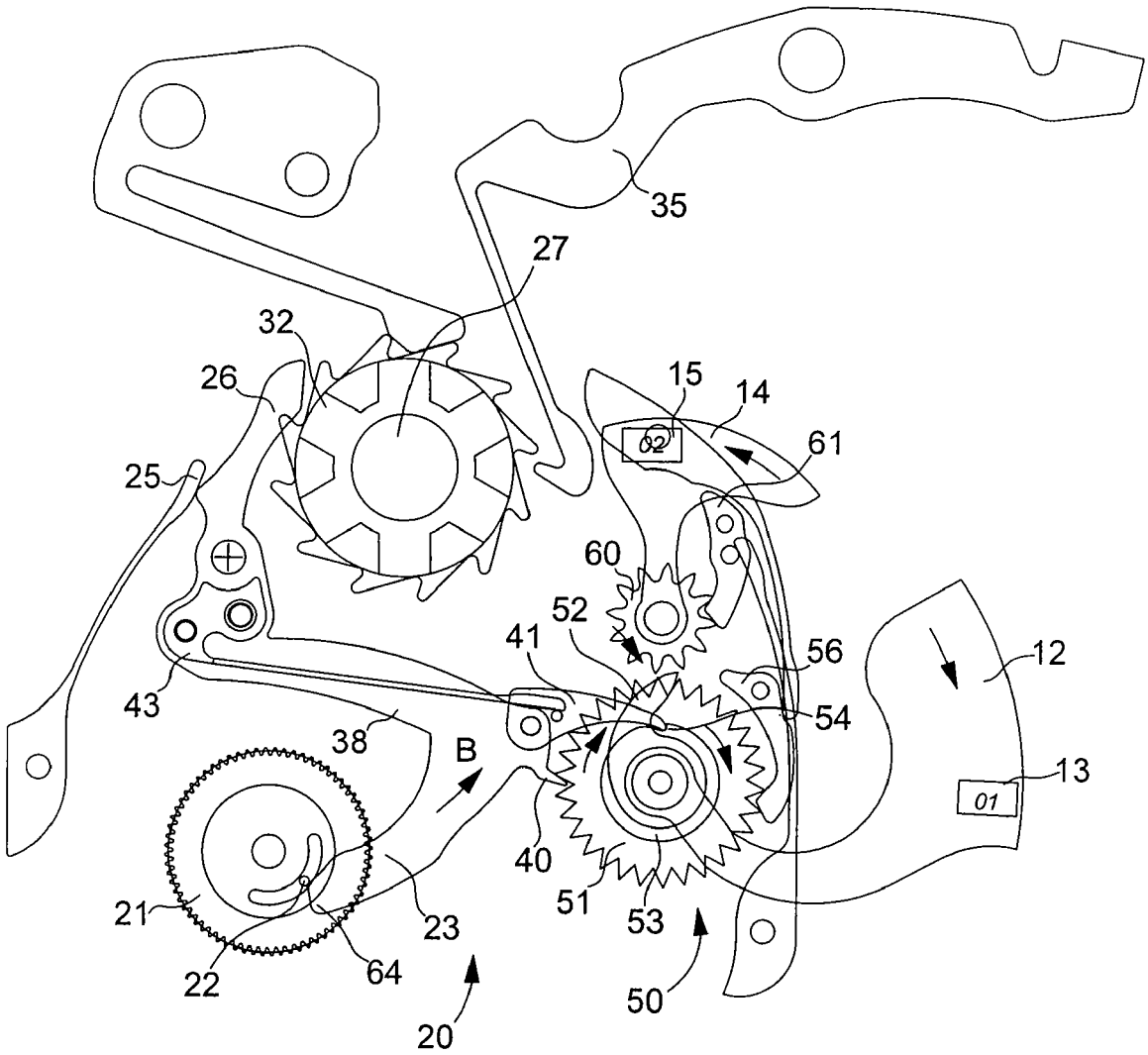

FIGS. 4 and 5 show the case in which the current lunar month is a short month, i.e. including only twenty-nine days. The position of selector 27 is then pivoted by one twelfth of a revolution in relation to that of FIGS. 2 and 3, such that the projecting portion 26*a* of arm 26 of lever 23 penetrates one of gaps 32 abutting against the two neighbouring columns 28 and such that the other end 64 of the lever is then further left than in the preceding case. The passage of selector 27 from one position to another is manually controlled, by means of a push-button 10 symbolised here by an arrow and producing a back and forth pivoting movement of selection lever 35 to move toothed wheel 33 forward one step by means of tooth 37.

Until the evening of the twenty-eighth day, the daily incrementing of the date in aperture 13 by the rotation of date wheel set 50 through one step occurs as in the preceding example, except that the initial idle motion of lever 23 and its beak 40 is larger. Click 41 slides over cam 53 without producing any effect.

On the twenty-ninth day, click 41 of the lever is in recess 54 of cam 53, as shown in FIG. 4. In the evening, pin 22 of drive wheel 21 produces the movement indicated by arrows in FIG. 5. The effect of the lever pivoting is that click 41 moves wheel set 50 forward one step, such that the date disc 12 will display the value 30 in aperture 13. A few minutes later, beak 40 of the lever enters into contact with wheel 51 and moves wheel set 50 forward another step, bringing date indication 01 into aperture 13 and simultaneously moving month wheel 60 and disc 14 forward one step, via drive finger 52, to increment the month number in aperture 15 by one unit.

Figure 6:
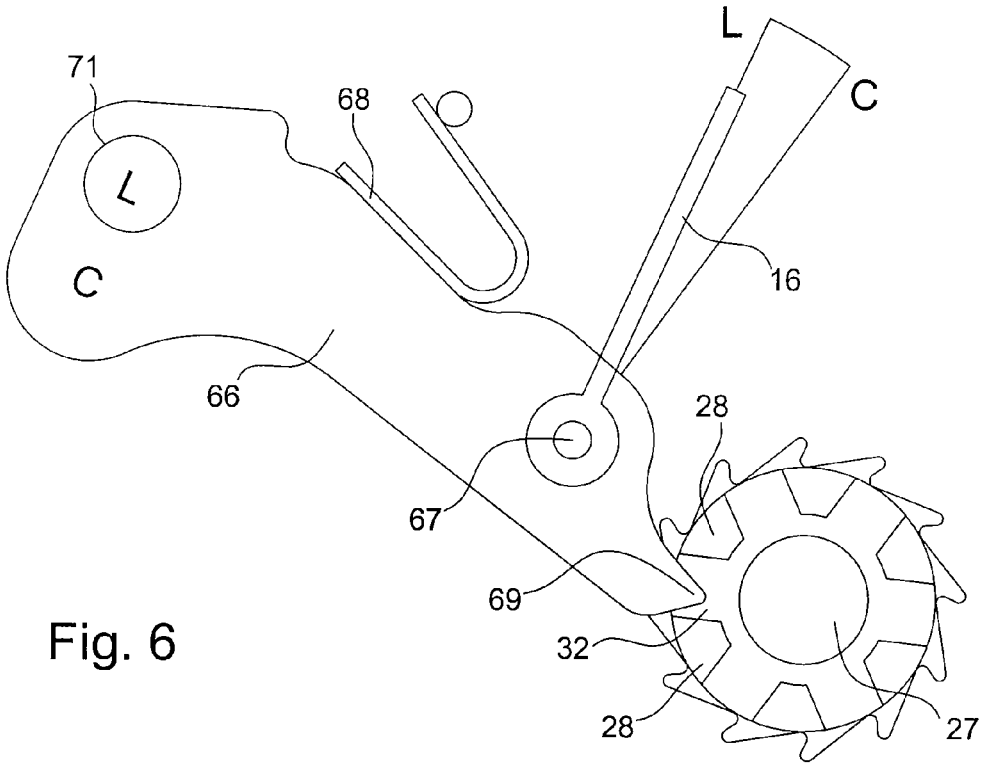
FIGS. 6 and 7 show another part of the mechanism actuating the Chinese calendar display of the watch of FIG. 1, in positions respectively corresponding to a long month and a short month.
Figure 7:
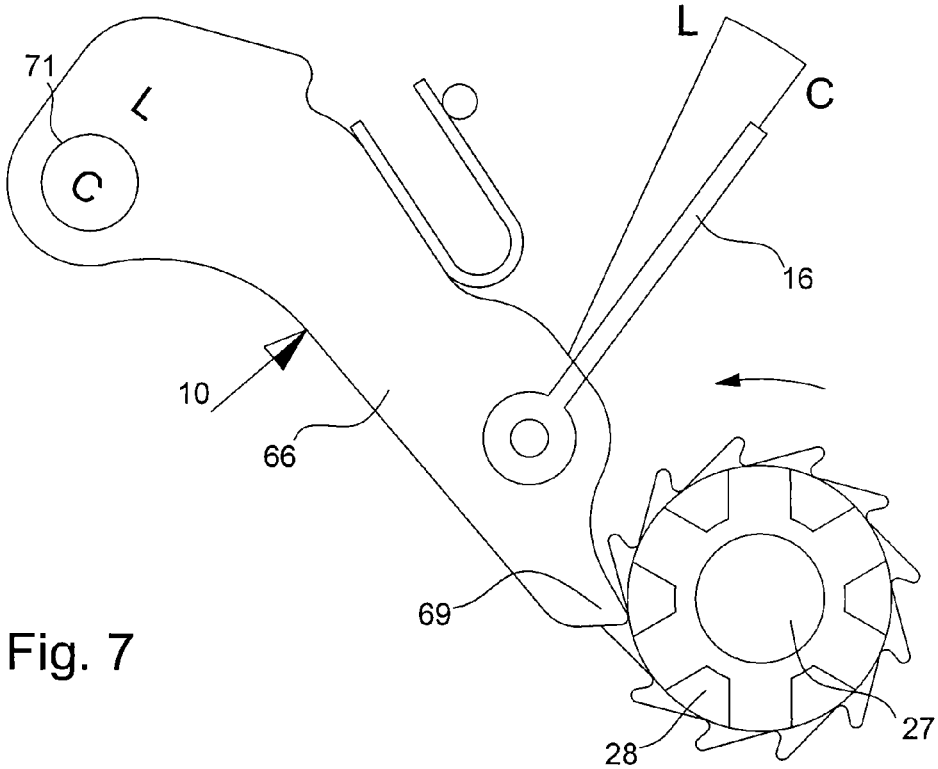
Figure 8:
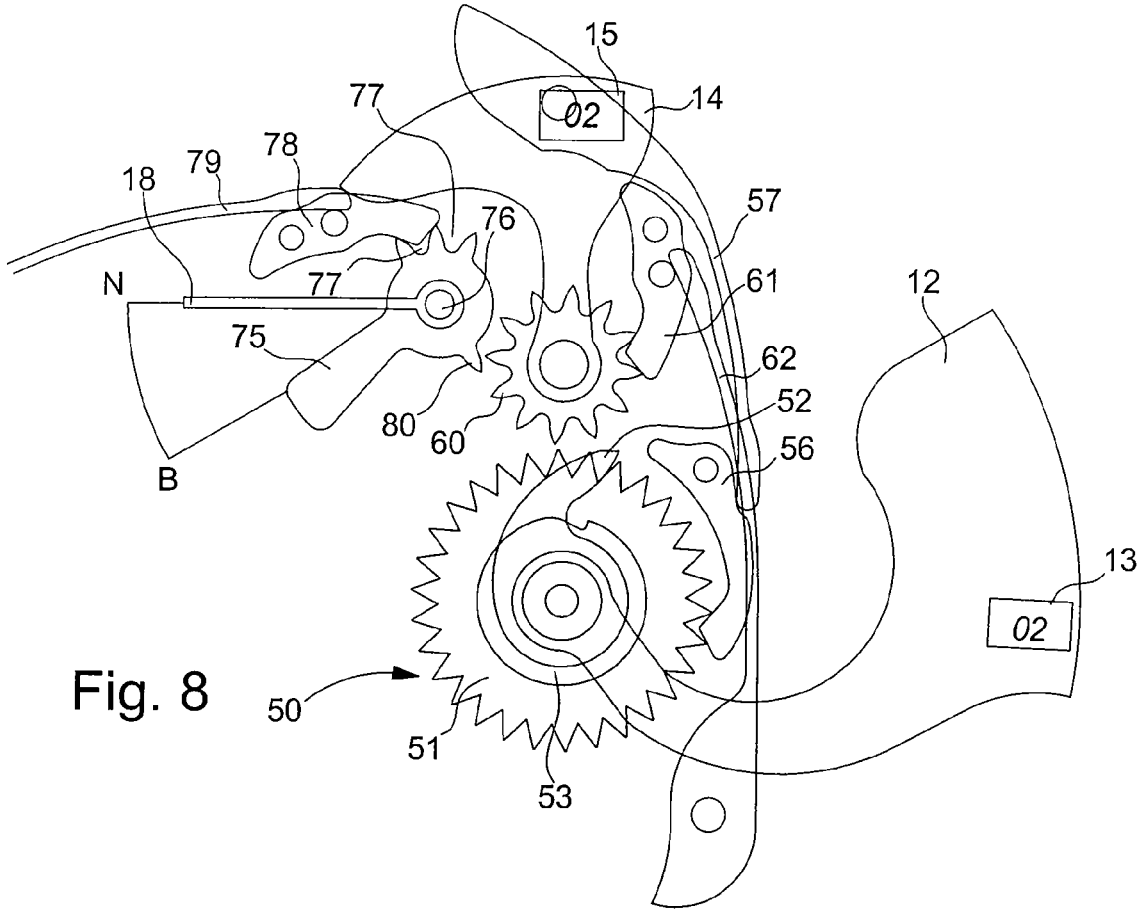
FIG. 8 shows a bissextile month selection device in the mechanism of FIG. 2.

FIGS. 6 and 7 show one part of mechanism 20 which is not shown in FIGS. 2 to 5 for the sake of clarity. This is the part forming the month length indicator, in particular with hand 16 shown in FIG. 1. This hand is secured to a lever 66 pivoting at 67 and stressed by a spring 68 such that its beak 69 is held pressed against the columns 28 of selector 27. When the position of the selector corresponds to a long month, as shown in FIG. 6, beak 69 and lever 66 penetrate one of gaps 32 abutting against two columns 28, so that hand 16 points to symbol L representing a long month. However, when the user manually rotates selector 27 by one twelfth of a revolution in the direction indicated by the arrow in FIG. 7, beak 69 is pushed back by the neighbouring column 28 and lever 66 pivots such that hand 16 points to symbol C representing a short month. The next step forward by selector 27 will return the mechanism to the position of FIG. 6.

By way of variant replacing the indication by hand 16, FIGS. 6 and 7 show that one can also apply the respective symbols L and C for the long and short months to lever 66, such that they appear in turn in an aperture 71 of the dial.

FIGS. 8 to 11 show one part of the date mechanism 20 described hereinabove, wherein a bissextile month selector 75 has been added, formed by a pivoting lever which is coupled to hand 18 shown in FIG. 1. Lever 75 pivots at 76 and has two notches 77 for stopping it in two positions by means of a jumper spring 78 shouldered by a spring 79. This lever is provided with a finger 80 which cooperates with the toothing of month wheel 60. Finger 80 is released from the toothing while selector 75 occupies its normal position shown in FIG. 8, where hand 18 is pointing to the symbol N indicating that the current month is a normal month. According to this Figure, it is the second month of the year, hence the indication 02 given by the month disc 4 in aperture 15.

Figure 9:
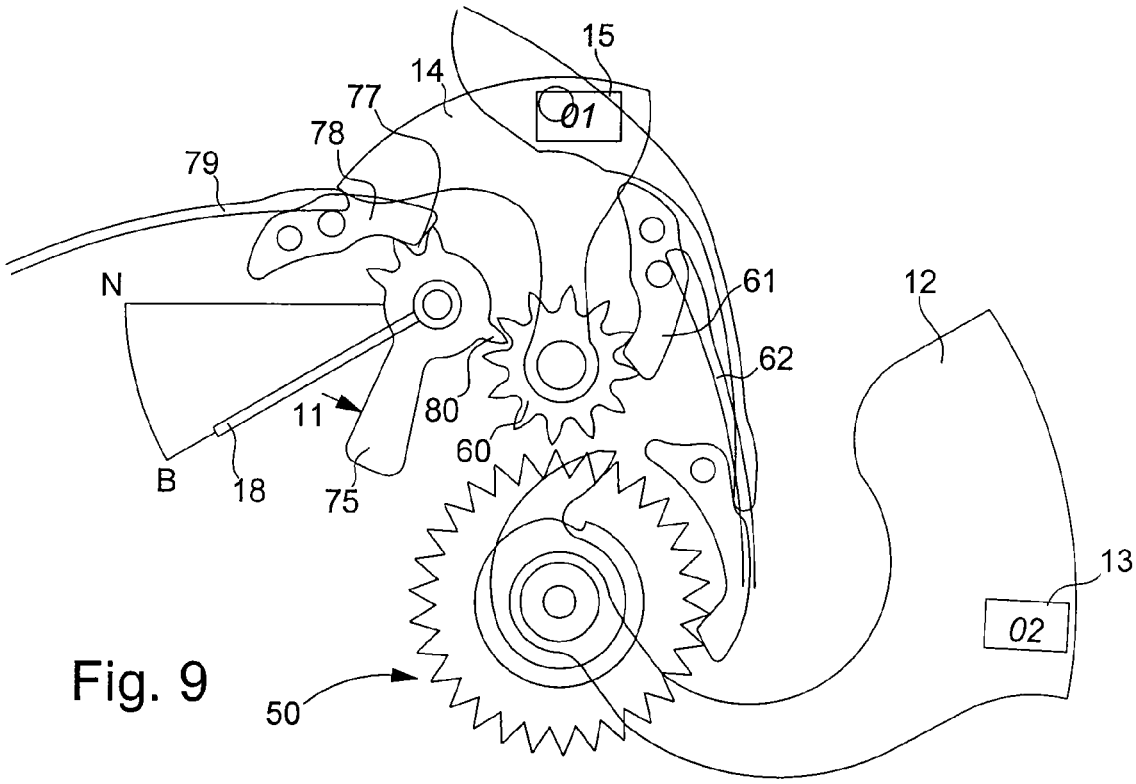
FIGS. 9 to 11 show the mechanism of FIG. 8 in other operating positions.

However, it is assumed here that this month is a bissextile month, a fact that the person wearing the watch has learned from a printed calendar, the press, or any other means. The user will then correct the calendar indication in the following manner. In FIG. 9, manual push-button 11 represented by an arrow acts on lever 75 to put it into its second position, such that hand 18 passes from symbol N to symbol B representing a bissextile month and finger 80 of the lever rotates month wheel 60 one step in the clockwise direction, thus moving the month number displayed in aperture 15 back by one unit. The current bissextile month thus returns to the number of the preceding month. It will be noted that this operation has no effect on date wheel set 50 and the date display in aperture 13.

Figure 10:
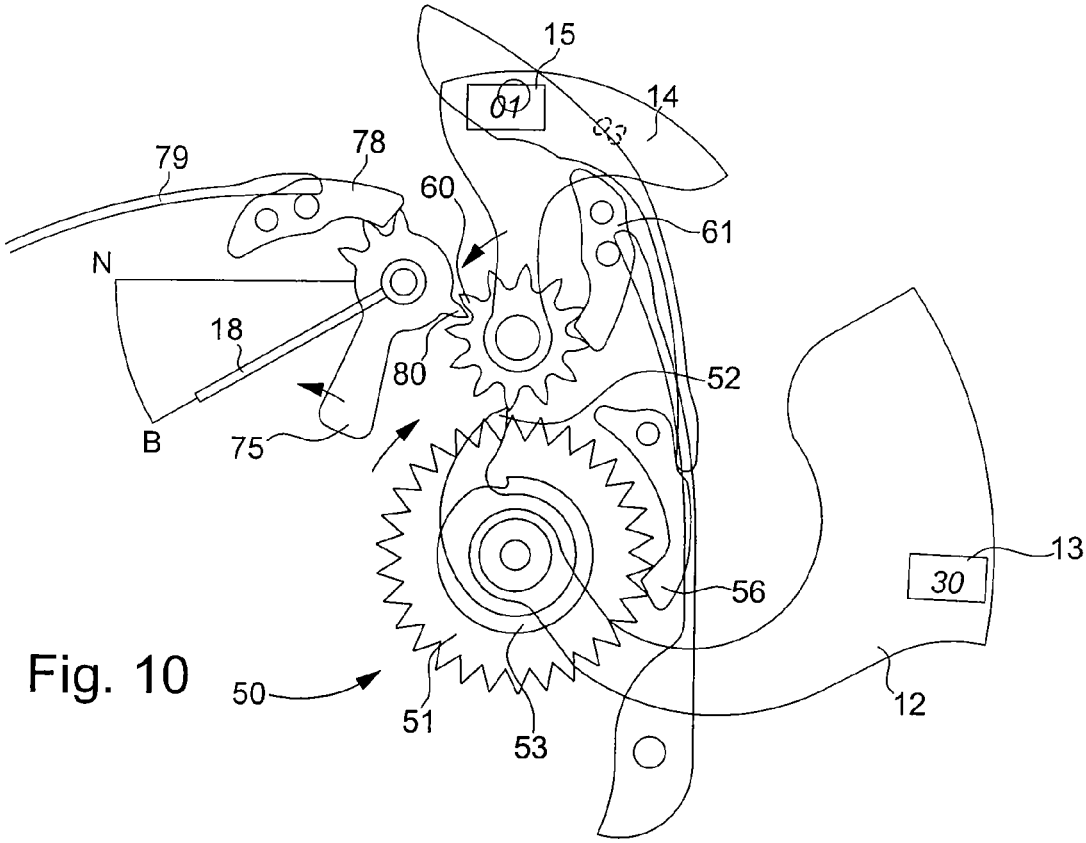
Figure 11:
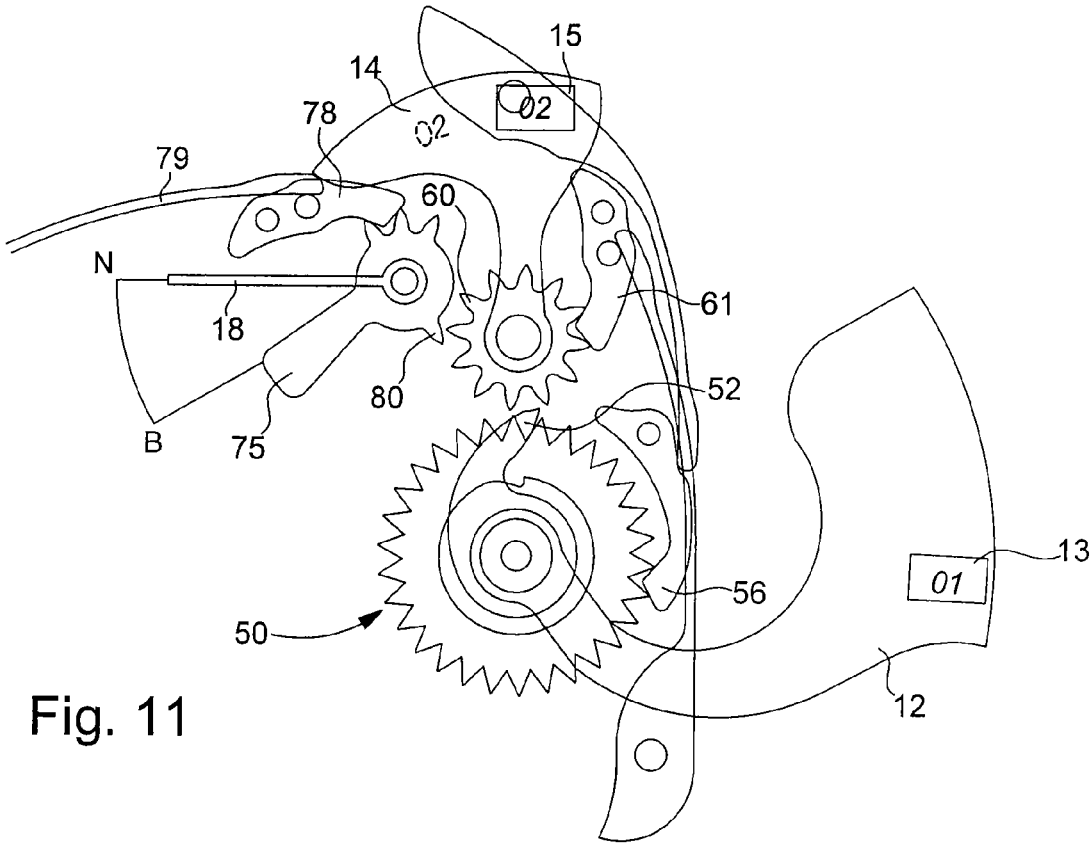

The arrows of FIG. 10 show the movements that occur at the end of the bissextile month, when the month drive finger 52 moves month wheel 60 and disc 14 forward one step in the anti-clockwise direction. This rotation will return bissextile month selector 75 to its normal position shown in FIG. 11, and at the same time it will make the number 02 of the new month that is beginning appear. Owing to the normal position of selector 75, all the ends of the following months will increment the month indicator normally, provided that push-button 11 has not been actuated again.

In light of the preceding description, it will be understood that the watch according to the invention correctly indicates the date and the number of the month in the Chinese calendar provided that the following actions are carried out:

1. During each month, the user must check whether the long or short month indication by the hand of indicator 16 is correct. If it is incorrect he must change it by pressing on push-button 10.

2. At the start of a bissextile month, the user must enter this information in the calendar mechanism by pressing on push-button 11, such that the bissextile month indicator 18 will pass from the N position to the B position, then return automatically to the N position at the end of the month.

Owing to these simple manual operations, it has become possible to make a Chinese calendar display mechanism which is not very complicated, such that it can be incorporated in a wristwatch, and which gives accurate indications throughout the year despite the non-cyclical nature of the Chinese character.

Figure 12:
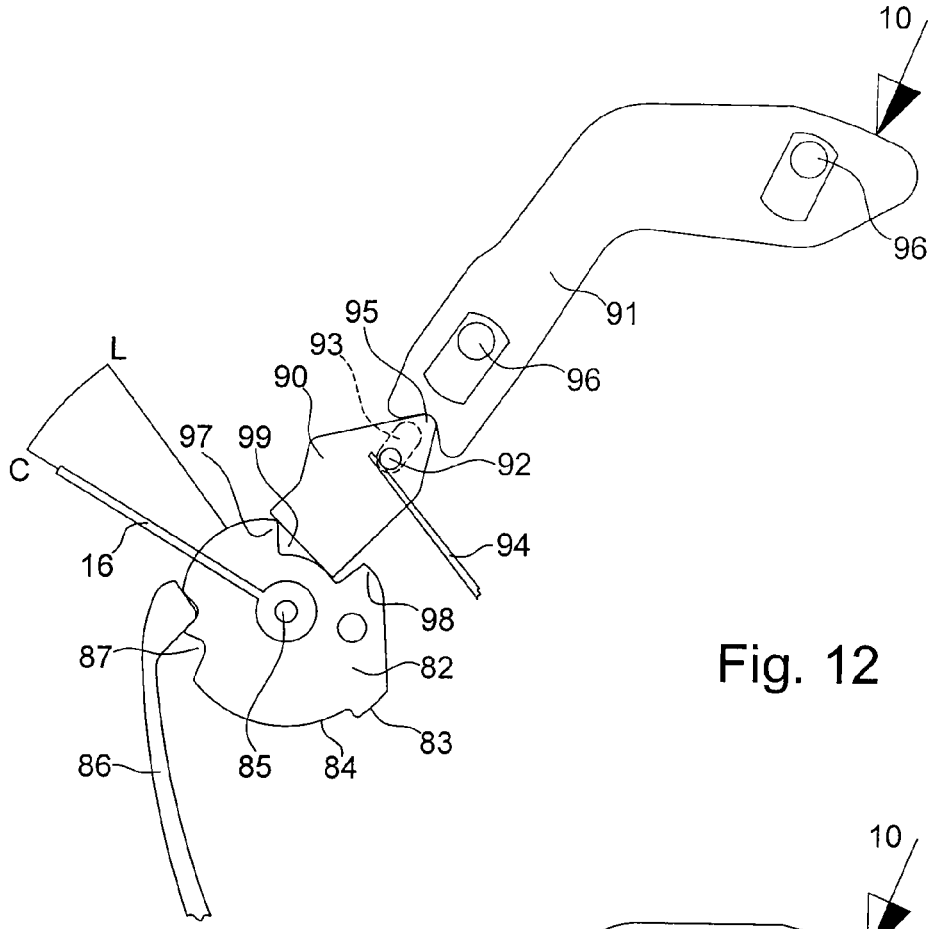
FIGS. 12 and 13 show a variant of the mechanism of FIGS. 6 and 7, in positions respectively corresponding to a long month and a short month.
Figure 13:
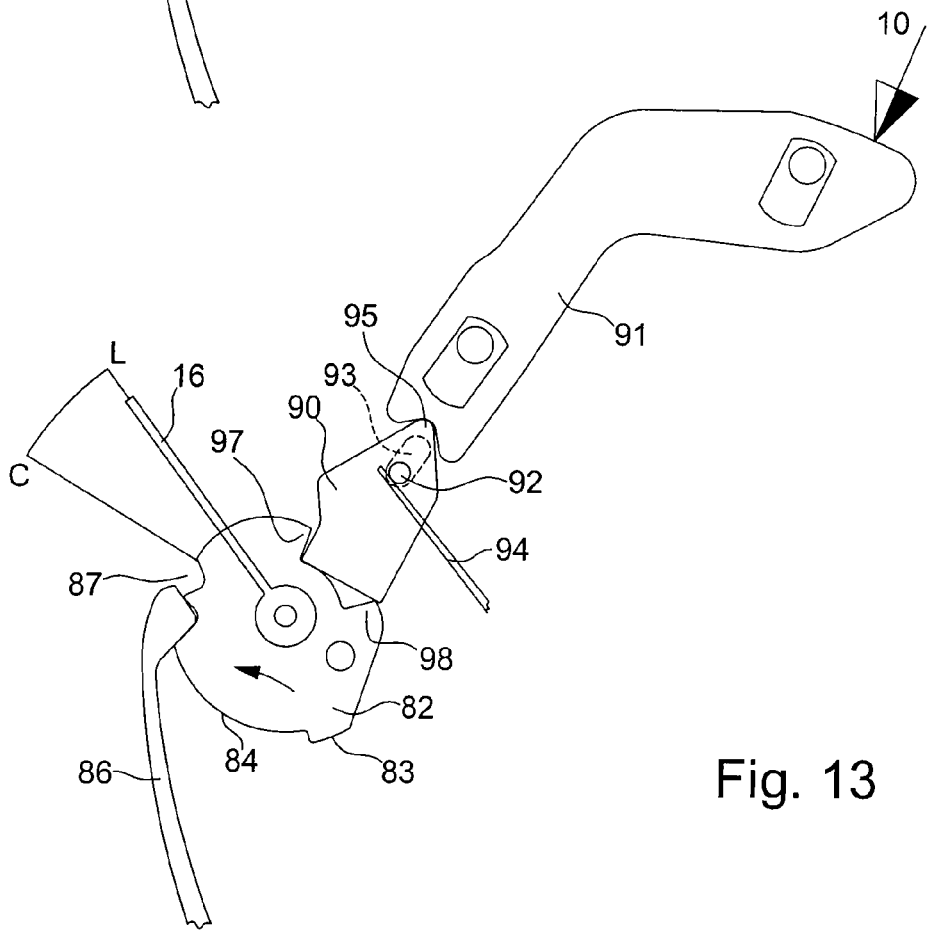

FIGS. 12 and 13 show a variant of one part of the calendar mechanism 20 described hereinbefore, namely a month length selector which replaces the rotating selector 27 and lever 66 shown in FIGS. 2 to 5. In this case, the hand of the month length indicator 16 is secured to a selector 82 pivoting back and forth, having two cam surfaces 83 and 84 against which lever 23 shown in FIGS. 2 to 5 can abut. Cam surface 83 has a larger radius than cam surface 84 in relation to the pivoting axis 85, to hold lever 23 in a position corresponding to a long month, as did a column 28 of the column wheel in the preceding example. Cam surface 84 constitutes the abutment point of the lever in the case of a short month. These two positions of selector 82 are stabilised by a jumper spring 86 engaging alternately in two notches 87 of the selector.

The switching of selector 82 from one position to the other by means of push-button 10 mentioned in the preceding example occurs by means of a shuttle transmission of known type, including a shuttle 90 and a slide-block 91. A pin 92 of shuttle 90 is guided linearly into a groove 93 of the plate of the movement and it is pushed back by a spring 94 so that one end 95 of the shuttle is pressed into a hollow of the corresponding end of slide-block 91. This latter is also guided linearly on two fixed pins 96. The front end of shuttle 90 has a rectangular shape and abuts alternately on one or other of the two projecting corners 97 and 98 arranged on either side of a hollow 99 of selector 82. When idle, spring 94 pushes shuttle 90 back away from the selector 82. At each application of pressure on push-button 11, shuttle 90 pushes that of corners 97 and 98 that are in front of it, which causes selector 82 and hand 16 to pivot towards the other position and to bring the other corner in front of the shuttle. The next application of pressure on push-button 11 thus produces the reverse effect, i.e. selector 82 has a back and forth movement.

Thus, the mechanism of FIGS. 12 and 13 replaces both selector 27 shown in FIGS. 2 to 5 and the lever indicator 66 shown in FIGS. 6 and 7.

Figure 14:
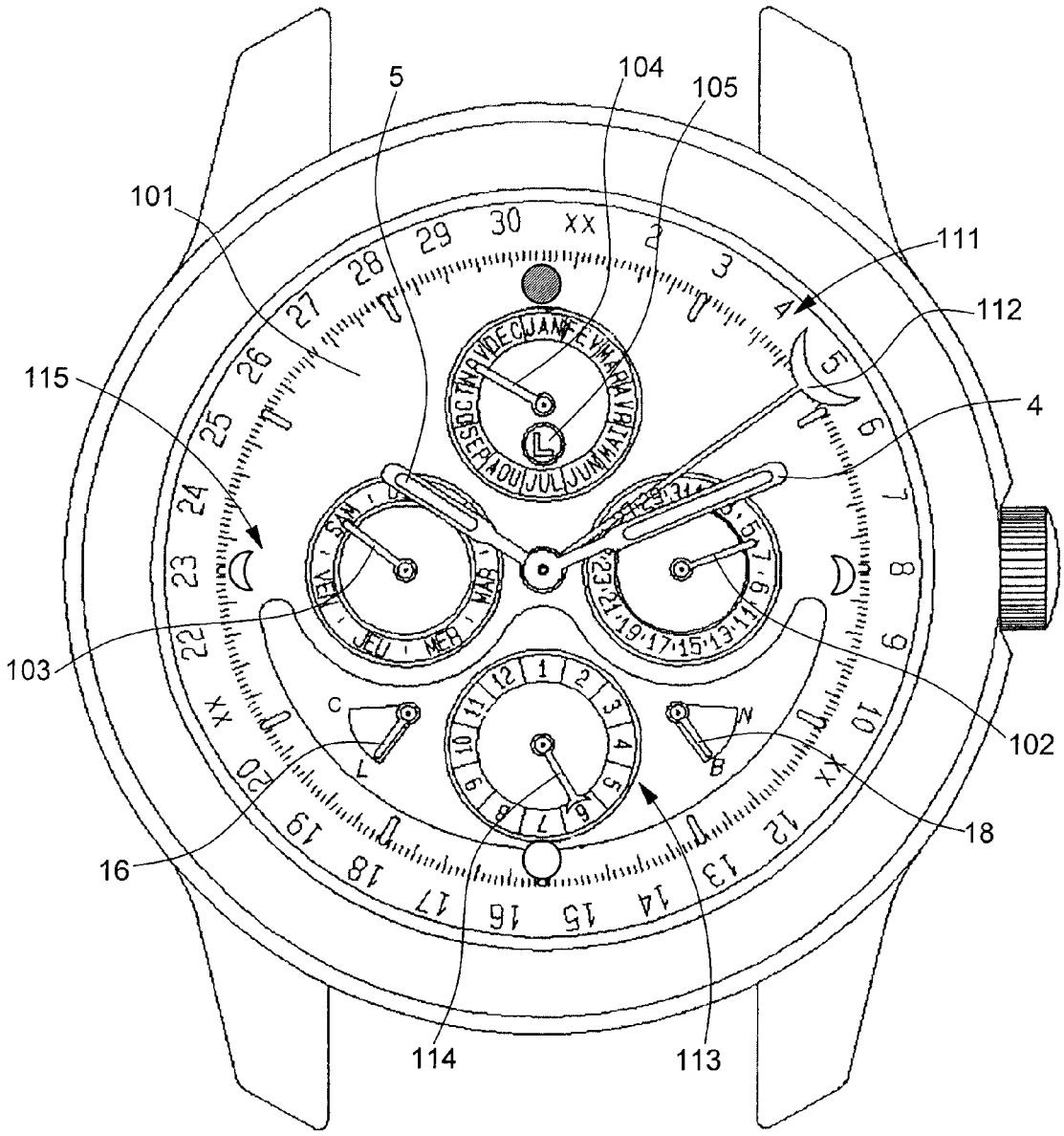
FIG. 14 is a plan view of a watch having a Chinese calendar display mechanism according to another embodiment of the invention.

FIG. 14 shows another embodiment of a watch according to the invention, having both a Chinese calendar display and a perpetual Julien calendar display on the same dial 101. The date in the Julien calendar is indicated by a date hand 102, a day of the week hand 103, a month hand 104 and a bissextile month indicator 105. The date in the Chinese calendar is indicated by a hand 112 indicating the date on a circular scale of lunar dates 111 and by a hand 114 indicating the lunar month on a circular scale 113. It will be noted that symbols 115 of the phases of the moon can be associated with lunar date scale 111. As in the preceding example, the Chinese calendar display further includes a month length indicator 16 and a month type indicator 18. The Chinese calendar indicators can be actuated by the same mechanism as in the preceding example, the two indicator discs 12 and 14 thereof simply being replaced by hands 112 and 114.

What is claimed is:

1. A timepiece including a timepiece movement and a Chinese calendar display device, wherein the Chinese calendar display device includes:

(a) a calendar mechanism including a first control lever actuated each day by a drive wheel of the timepiece movement;

(b) a lunar month indicator associated with a month star-wheel having twelve teeth;

(c) a lunar date indicator associated with a date wheel set including a date wheel with thirty teeth that is moved forward one step each day by a beak of the first control lever, the date wheel set further including a drive finger arranged to move the month star-wheel forward one step at the end of each revolution of the date wheel set;

(d) a lunar month length selector, having at least two positions and cam surfaces acting as a support for the first control lever, to define alternately two different stop positions for the first control lever, respectively corresponding to a month of thirty days and to a month of twenty-nine days, wherein the first control lever is provided with a click cooperating with the date wheel set in order to move the date wheel set one extra step via movement of the first control lever at the end of a month of twenty nine days;

(e) a first manual control member arranged for changing position of the lunar month length selector;

(f) a bissextile month selector, having a normal position and a bissextile position and provided with a finger arranged for making the month star-wheel move back one step when the selector passes from the normal position to the bissextile position; and (g) a second manual control member arranged for making the bissextile month selector pass from the normal position to the bissextile position.

2. The timepiece according to claim 1, wherein the lunar month length selector is coupled to a month length indicator visible on a dial of the timepiece.

3. The timepiece according to claim 2, wherein the lunar month length selector is a pivoting element having said cam surfaces and two positions that are stabilised by a jumper spring, and said pivoting element is secured to the month length indicator.

4. The timepiece according to claim 3, wherein the first manual control member is a push button arranged for moving the lunar month length selector alternately from one position to another position via a shuttle transmission.

5. The timepiece according to claim 1, wherein the bissextile month selector is coupled to a month type indicator visible on a dial of the timepiece.

6. The timepiece according to claim 1, wherein the lunar month length selector is formed by a colunm wheel whose columns form said cam surfaces, the column wheel further including a toothing, the number of teeth of the toothing is twice the number of columns and is held in position by a jumper spring.

7. The timepiece according to claim 6, wherein the first manual control member is a push button activating a second lever having a flexible arm provided with one tooth arranged for moving said tooth forward step by step.

8. The timepiece according to claim 6, wherein the month length indicator is secured to a second lever that is held pressed against said columns by a spring.

9. The timepiece according to claim 1 in the form of a wristwatch.

* * * * *